US005165671A

United States Patent [19]

Motooka

[11] Patent Number: 5,165,671

[45] Date of Patent: Nov. 24, 1992

[54] FOLDING MACHINE FOR BOTH INSIDE AND OUTSIDE THREE FOLDING OPERATIONS

[75] Inventor: Mikio Motooka, Hiroshima, Japan

[73] Assignee: Mitsubishi Jukogyo Kabushiki Kaisha, Tokyo, Japan

[21] Appl. No.: 745,343

[22] Filed: Aug. 15, 1991

[30] Foreign Application Priority Data

Aug. 20, 1990 [JP] Japan ..... 2-217151

[51] Int. Cl.[5] ..... B42C 1/00

[52] U.S. Cl. ..... 270/47; 270/49; 270/211; 493/432

[58] Field of Search ..... 270/21.1, 45, 47, 48, 270/49, 50, 60; 493/424–433

[56] References Cited

U.S. PATENT DOCUMENTS 4,378,268 3/1983 Lehmacher ..... 270/47
4,445,881 5/1984 Bullen ..... 493/427

FOREIGN PATENT DOCUMENTS 19202 11/1980 European Pat. Off. ..... 493/432
1376611 9/1964 France .
2307743 4/1976 France .
2078684 1/1982 United Kingdom ..... 270/47

*Primary Examiner*—Edward K. Look
*Assistant Examiner*—Therese M. Newholm
*Attorney, Agent, or Firm*—Jacobson, Price, Holman & Stern

[57] ABSTRACT

A folding machine for both inside and outside three folding operations comprising a cutter drum (1) having a saw blade (1*a*) thereon, a folding drum (2) having saw blade receivers (2*a*), needles (2*b*), and folding blades (2*c*), a first holding drum (21) having holding devices (21*a*) and folding blades (21*c*), a second holding drum (22) having holding devices (22*a*), and raising devices (23) for preventing the interference of web A disposed in proximity to the saw blade receivers (2*a*) on the folding drum (2) so that both inside and outside three folding operations can be performed.

6 Claims, 8 Drawing Sheets

FOLDING MACHINE FOR BOTH INSIDE AND OUTSIDE THREE FOLDING OPERATIONS

BACKGROUND OF THE INVENTION

This invention relates to the arrangement and the construction of drums which can perform both inside and outside three folding operations and are applied to folding machines.

FIG. 7 shows a conventional folding machine for both inside and outside three folding operations.

The folding machine of this type has a cutter drum 1, a first folding drum 2, a first holding drum 3, a second folding drum 4, and a second holding drum 5. Each of these drums 1, 2, 3, 4 and 5 has a saw blade 1*a* (a member composing a drum is indicated by attaching a, b, c, and so on to the drum number); saw blade receivers 2*a*, needles 2*b*, and folding blades 2*c*; first holding means 3*a* and second holding means 3*b* which are interchangeable with each other or folding blades 3*c*; a pawl 4*a* and a folding blade 4*c*; and pawls 5*a* and holding means 5*b*, respectively.

When an inside three folding operation is performed by using this folding machine, a web A is drawn into the machine through first-stage nipping rollers 10 and second-stage nipping rollers 11 as shown in FIG. 8*a* to FIG. 8*f*. The web A drawn into the machine is caught by the sticking of needle 2*b*, and at the same time the leading edge of web A is cut by the saw blade 1*a* on the cutter drum 1 and the saw blade receiver 2*a* on the first folding drum 2 (refer to FIG. 8(*a*)). Next, the web A moves around the first folding drum 2 by being hooked by the needle 2*b*, and then is cut into a predetermined length by the saw blade 1*a* which has revolved one turn (refer to FIG. 8(*b*)). After that, a first fold is made on the web A at the position one-third length distant from the needle-side edge (hereinafter called needle-side $\frac{1}{3}$ position) with the folding blade 2*c* on the first folding drum and the first holding means 3*a* on the first holding drum 3 (refer to FIG. 8(*c*)). Then, the web A is held by the pawl 4*a* on the second folding drum 4, and a second fold is made at the position one-third length distant from the first fold position (needle-side $\frac{2}{3}$ position) with the folding blade 4*c* on the second folding drum 4 and the second holding means 3*b* on the first holding drum 3 (refer to FIGS. 8(*d*) and 8*e*)). The above-described operation completes inside three fold of web A as shown in FIG. 8(*f*).

This three-folded web, as shown in FIG. 7, being held by the pawl 5*a* on the second holding drum 5 in place of the holding means 3*b* on the first holding drum 3, is carried out of the machine through a carrying belt 6, an impeller 8, and a paper discharge conveyor 9. Alternatively, it is carried out of the machine through a carrying belt 6, a chopper 7, an impeller (not shown), and a paper discharge conveyor 9.

When an outside three folding operation is performed by using this folding machine, a web A is cut into a predetermined length in the same way as described above as shown in FIG. 9*a* to FIG. 9*f*. Then, a first fold is made at the needle-side $\frac{1}{3}$ position with the folding blade 2*c* on the first folding drum 2 and the first holding means 3*a* on the first holding drum 3 (refer to FIGS. 9(*a*) through 9(*c*)). After that, the second fold is made in the direction reverse to the direction of the inside three folding operation with the second folding blade 3*c* which replaces the second holding means 3*b* on the first holding drum 3 and the holding means 5*b* on the second holding drum 5 (refer to FIGS. 9(*d*) and 9(*e*)). This operation completes outside three folding as shown in FIG. 9(*f*); the three-folded web is carried out of the machine.

The changeover from inside three folding to outside three folding is performed as follows: First, a clutch (not shown) is released, which is installed on the shaft of the second folding drum 4 driven by the first holding drum 3. Then, while the second folding drum 4 is fixed, the second holding means 3*b* (or the second folding blade 3*c*) on the first holding drum 3 is replaced with the second folding blade 3*c* (or the second holding means 3*b*), and the position of the first holding means 3*a* on the first holding drum 3 where the web leaves the drum is changed. In addition, the timing is changed on the chopper 7, the impeller 8, or the impeller not shown (for chopper folding) following the carrying belt 6. The changeover from outside three folding to inside three folding is performed in the way reverse to the way described above.

The above-described conventional method has the following problems:

(1) When the changeover from inside three folding to outside three folding or in reverse is performed, the second holding means 3*b* or the second folding blade 3*c* must be removed from the first holding drum 3, and replaced with the second folding blade 3*c* or the second holding means 3*b*. This replacing operation is complicated and time-consuming. In replacing, the position of the first holding means 3*a* on the first holding drum 3 where the web leaves the drum must be changed because some difference in position between the second holding means 3*b* and the second folding blade 3*c* arises. In order to adjust this position, a cam must be moved. The cam must be adjusted finely; if this fine adjustment is not made accurately, the accuracy of folding may decrease.

In addition, a clutch must be installed to disengage the driving of the second folding drum 4 from the first holding drum 3.

Further, the timing of components following the carrying belt must be changed in accordance with the adjustment of cam.

(2) The second holding drum 5 is installed for an outside three folding operation. Therefore, an inside three folded web is discharged onto the carrying belt 6 from the drum 5 after it is received by the pawl 5*a* on second holding drum 5. This may cause easy shift in the position of the web, decreasing the accuracy of chopper folding and the accuracy of carrying to the impeller. As a result, some problems may arise with the postprocessing equipment.

(3) When an inside three folding operation is performed, the needle hole comes inside. When cutting of the needle hole portion is needed as with catalogs, cutting is made to remove the needle hole portion. This requires cutting of the remaining two pieces of paper overlapping with the needle hole portion, excessive paper being consumed (loss of paper).

BRIEF SUMMARY OF THE INVENTION

This invention provides a solution to the above-described problems with the prior art. The objects of this invention, therefore, are as follows:

(1) Both inside and outside three folding operations are performed by using two pairs of folding blades and holding means.

(2) In both inside and outside three folding operations, folding is performed so that the needle hole comes outside.

To achieve the above objects, this invention provides a folding machine for both inside and outside three folding operations comprising a cutter drum 1 having a saw blade 1*a*, a folding drum 2 having saw blade receivers 2*a*, needles 2*b*, and folding blades 2*c*, a first holding drum 21 having holding means 21*a* and folding blades 21*c*, and a second holding drum 22 having holding means 22*a*, wherein raising means for preventing the interference of web A are disposed in proximity to the saw blade receiver 2*a* on the folding drum 2 so that inside and outside three folding operations can be performed.

The inside and outside three folding operations are performed by changing the position of the first fold from the needle side.

By the above-described construction, this invention is carried out as follows:

(1) A web A is cut into a predetermined length with the saw blade 1*a* on the cutter drum 1 and held by the needle 2*b* on the folding drum. On the web A, a first fold is made with the folding blade, 2*c* on the folding drum 2 and the holding means 21*a* on the first holding drum 21, and then a second fold is made with the folding blade 21*c* on the first holding drum 21 and the holding means 22*a* on the second holding drum 22. Thus, both inside and outside three folding operations are performed with the needle hole being outside.

In the inside three folding operation, the first fold is made at the needle-side $\frac{2}{3}$ position, whereas in the outside three folding operation, the first fold is made at the needle-side $\frac{1}{3}$ position. For changeover from inside three folding to outside three folding or in reverse, the saw blade 1*a* on the cutter drum 1 and the saw blade receiver 2*a* and the needle 2*b* on the folding drum 2 are moved in relation to the folding blade 2*c* on the folding drum 2.

(2) The raising means for preventing interference raises the web A which is being three-folded, so that the leading edge of web B which follows the web A and the tip of needle 2*b* which holds the leading edge of web B do not come into contact with (not interfere with) the web A which is being three-folded. This provides satisfactory folds without edge folding or paper tearing of the web which is being folded.

The folding machine for both inside and outside three folding operations according to this invention produces the following effects:

(1) Because the inside and outside three folding operations are performed by using two pairs of folding blade and holding means, the number of drums can be decreased as compared with the conventional folding machine for both inside and outside folding operations, resulting in a simplified construction of machine. In addition, because the number of operations to change holding is decreased, the shift of web is minimized, resulting in the increase in chopper folding accuracy and the carrying accuracy.

(2) The changeover from inside three folding to outside three folding or in reverse is performed merely by moving the needle and saw blade receiver and saw blade which have no direct effects on the folding accuracy; there is no need for replacing the holding means and folding blade which have effects on the folding accuracy as with the conventional folding machine. Therefore, the cam for adjusting the folding timing of these members requires no frequent adjustment, good folding accuracy being maintained.

(3) By using the raising means for preventing interference, the leading edge of the web following the web which is being folded does not interfere with the latter web. This eliminates the problems of edge folding and paper tearing.

(4) The needle hole comes outside for both inside and outside three folding operations, so that only a sheet of the outside folded portion with needle hole is cut for the folds on which the needle hole portion must be cut in inside three folding operation, such as catalogs, resulting in the saving of paper (decrease in paper loss).

BRIEF DESCRIPTION OF THE DRAWINGS

The invention will now be described in detail with reference to the accompanying drawings, wherein.

DETAILED DESCRIPTION OF PREFERRED EMBODIMENTS

Figure 1:
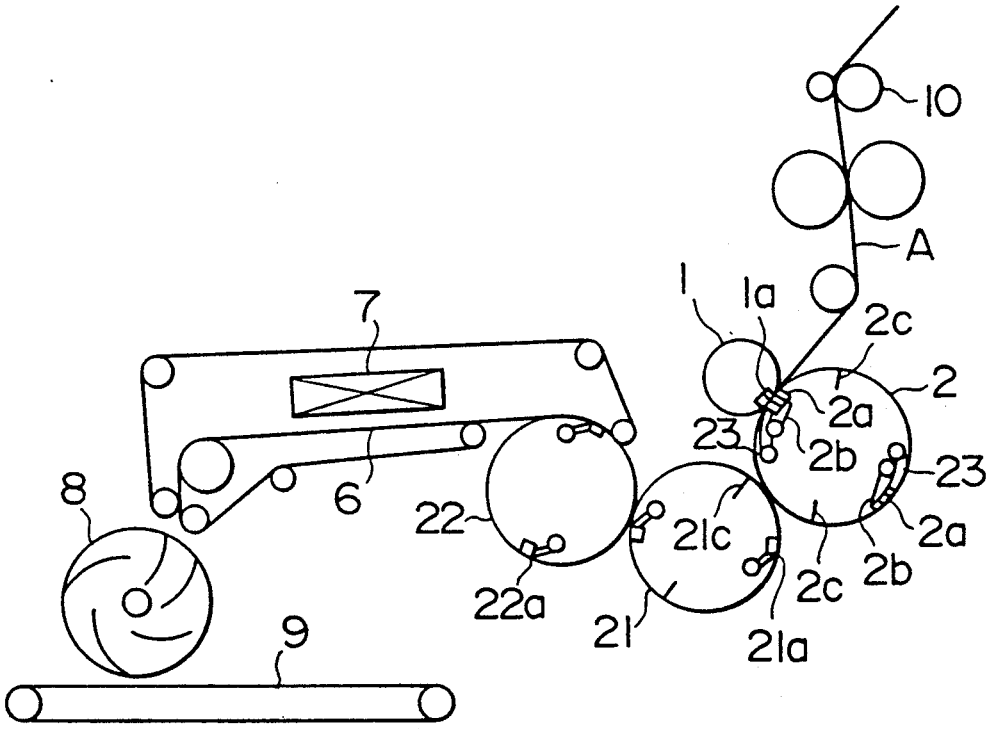
FIG. 1 is a schematic side view showing the arrangement and construction of drums of a three-folding machine according to an embodiment of this invention.
Figure 2A:
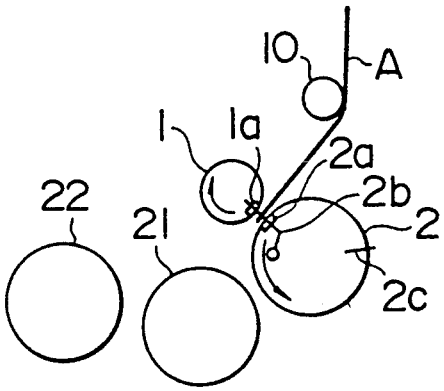
FIGS. 2(*a*) through 2(*e*) are schematic side views showing the process for performing an inside three folding operation by using the machine shown in FIG. 1.
Figure 2D:
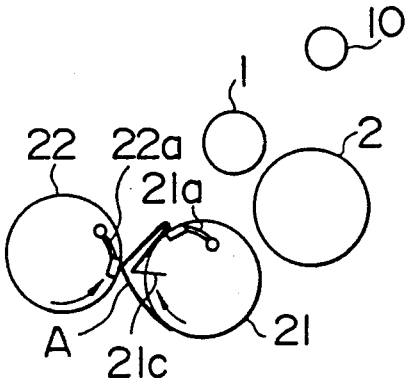
Figure 2B:
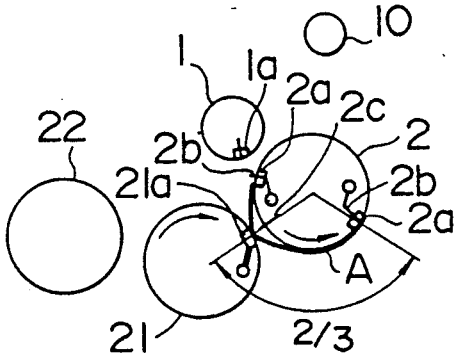
Figure 2E:
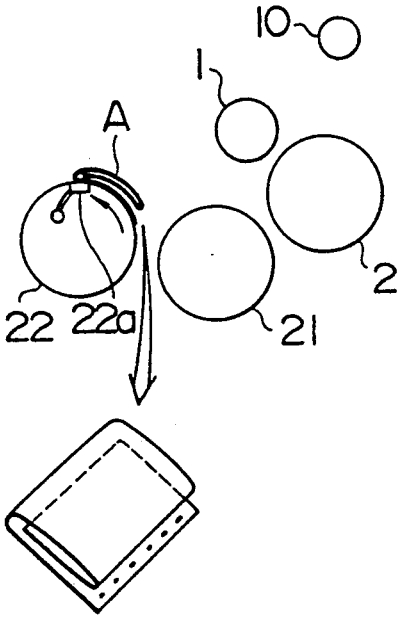
Figure 2C:
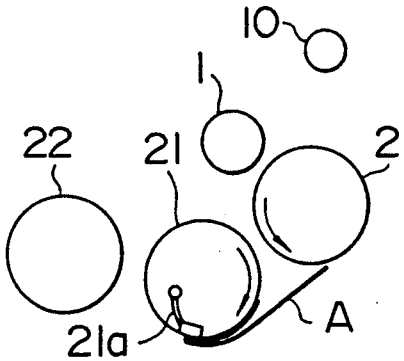
Figure 3A:
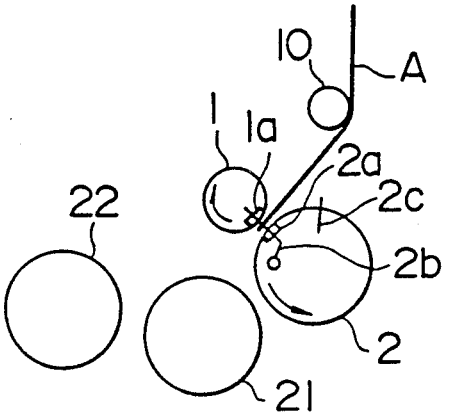
FIGS. 3(*a*) through 3(*e*) are schematic side views showing the process for performing an outside three folding operaton by using the machine shown in FIG. 1.
Figure 3D:
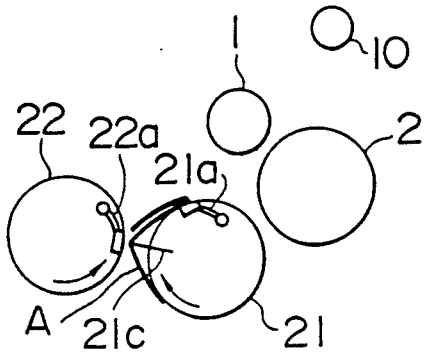
Figure 3B:
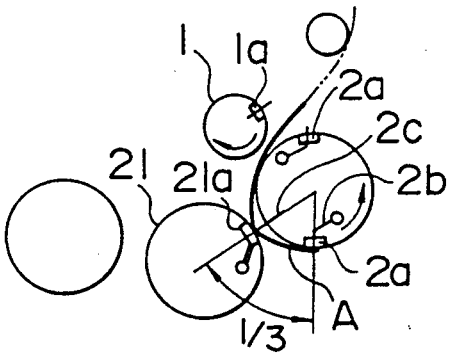
Figure 3E:
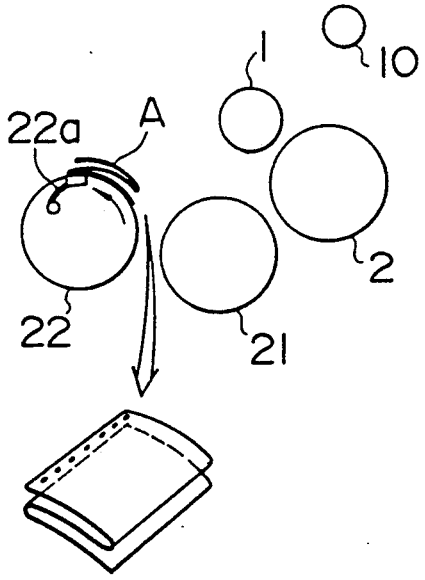
Figure 3C:
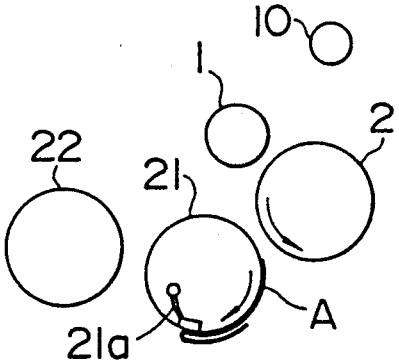

FIG. 1 shows a folding machine for both inside and outside three folding operations according to this invention.

This folding machine has a cutter drum 1, a folding drum 2, a first holding drum 21, and a second holding drum 22.

Each of these drums 1, 2, 21 and 22 has a saw blade 1*a*; saw blade receivers 2*a*, needles 2*b*, folding blades 2*c*, and raising means for preventing interference 23; first holding means 21*a* and folding blades 21*c*; and holding means 22*a*, respectively.

When an inside three folding operation is performed by using this folding machine, a web A drawn into the machine through nipping rollers 10 or other means as shown in FIG. 2, is caught by the sticking of needle 2*b*, and at the same time the leading edge of web A is cut by the saw blade 1*a* on the cutter drum 1 and the saw blade receiver 2*a* on the folding drum 2 (refer to FIG. 2(*a*)). Next, the web A moves around the folding drum 2 by being hooked by the needle 2b, and then is cut into a predetermined length by the saw blade 1a which has revolved one turn (refer to FIG. 2(*b*)). After that, a first fold is made on the web A at the needle-side $\frac{2}{3}$ position with the folding blade 2c on the folding drum 2 and the holding means 21a on the first holding drum 21 (refer to FIGS. 2(*b*) and 2(*c*)). Then, a second fold is made at the needle-side $\frac{2}{3}$ position with the folding blade 21c on the first holding drum 21 and the holding means 22a on the second holding drum 22 (refer to FIGS. 2(*d*)). The above-described operation completes inside three folding of web A with the needle hole being outside as shown in FIG. 2(*e*).

The inside three folded web is carried out of the machine from the second holding drum 22 through a carrying belt 6, an impeller 8, and a paper discharge conveyor 9.

When an outside three folding operation is performed, the saw blade 1a on the cutter drum 1 and the saw blade receiver 2a and the needle 2b on the folding drum 2 are moved from the needle-side $\frac{2}{3}$ position to the needle-side $\frac{1}{3}$ position in relation to the folding blade 2c on the folding drum 2. In this condition, as shown in FIG. 3, a first fold is made at the needle-side $\frac{1}{3}$ position with the folding blade 2c on the folding drum 2 and the holding means 21a on the first holding drum 21 (refer to FIGS. 3(*a*) and 3(*b*). Then, a second fold is made at the needle-side $\frac{2}{3}$ position with the folding blade 21c on the first holding drum 21 and the holding means 22a on the second holding drum 22 (refer to FIGS. 3(*c*) and 3(*d*)). The above-described operation completes outside three folding of web A, and the folded web is carried out of the machine as described above.

Figure 4:
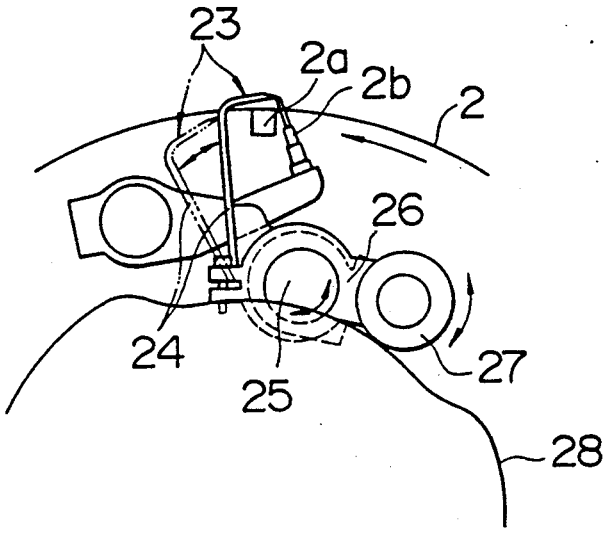
FIG. 4 is a side view of a raising means for preventing interference installed on the folding drum of the machine of this invention.
Figure 5:
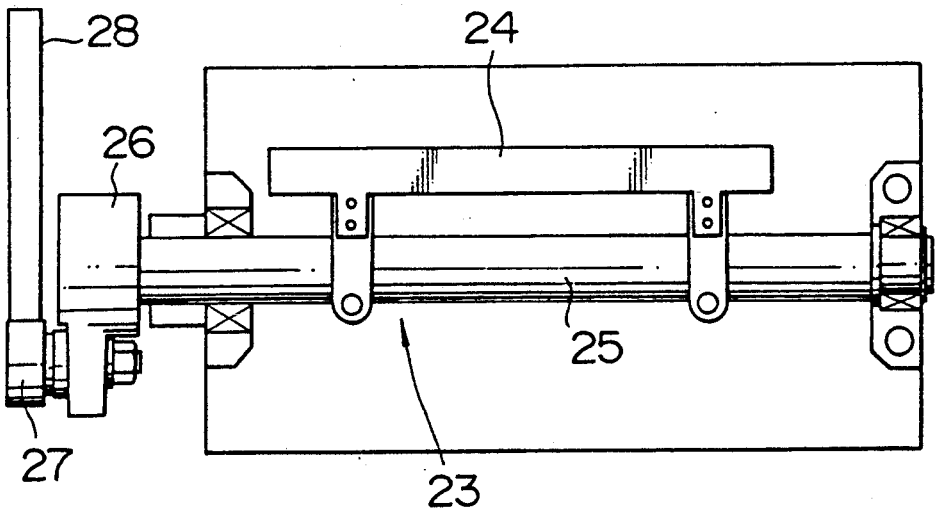
FIG. 5 is a top plan view of the raising means for preventing interference shown in FIG. 4.

In the inside three folding operation, as described above, the first folding portion is as long as $\frac{2}{3}$ the length from the needle side. Therefore, the web B hooked by the next needle 2b may come into contact with the web A which is hooked by the preceding needle 2b and subjected to the first folding (refer to FIG. 6(C)). To avoid this contact, raising means 23 for preventing interference shown in FIGS. 4 and 5 are installed at the positions of the saw blade receivers 2a on the folding drum 2.

Figure 6A:
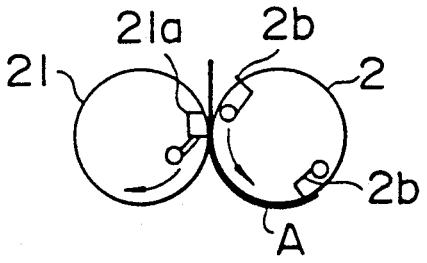
FIGS. 6(A) through 6(D) show the operation timing of the raising means for preventing interference.
Figure 6B:
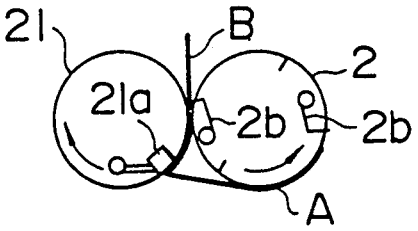
Figure 6C:
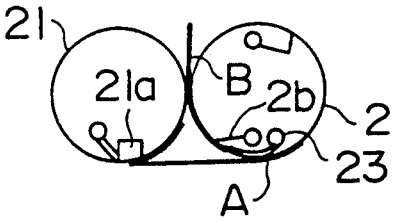
Figure 6D:
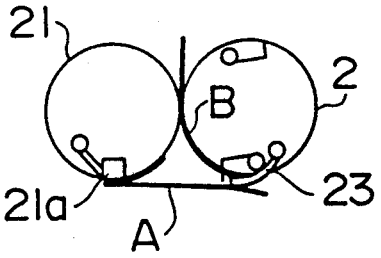
Figure 7:
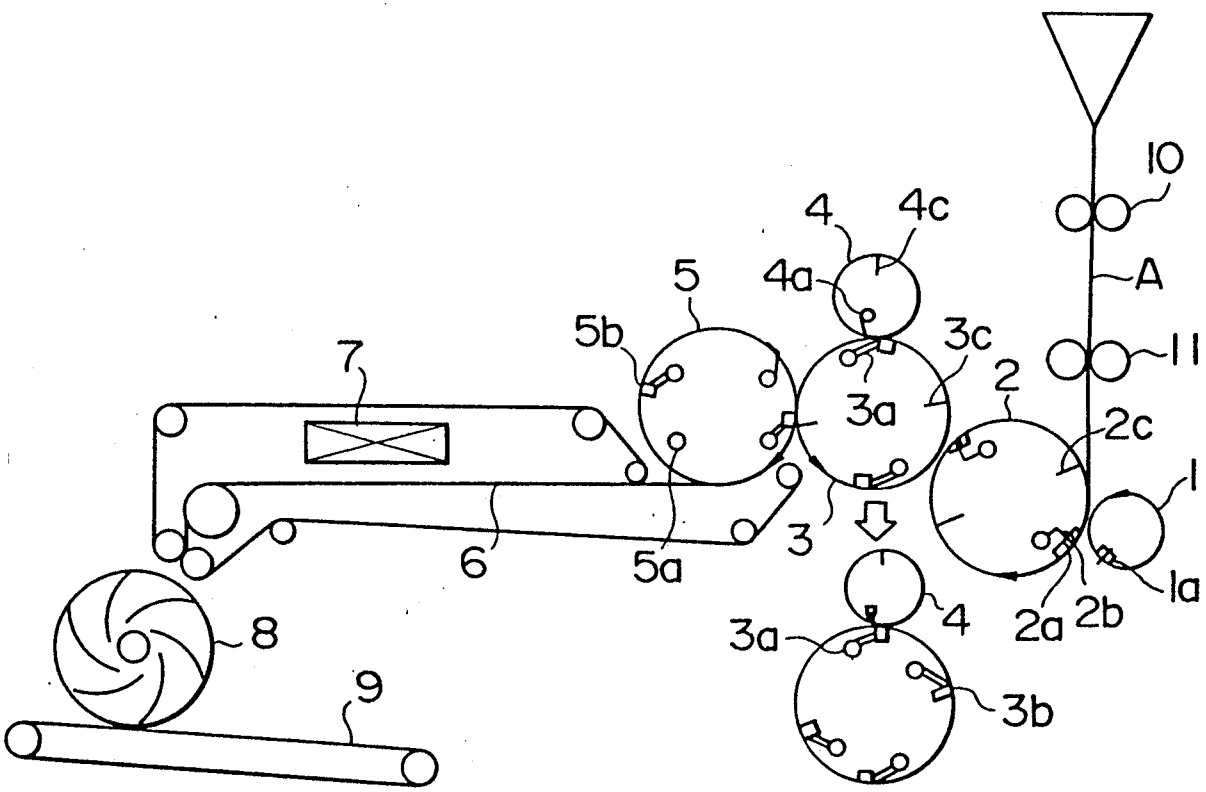
FIG. 7 PRIOR ART
FIG. 7 is a side view showing the arrangement and construction of drums of a conventional three-folding machine.
Figure 8A:
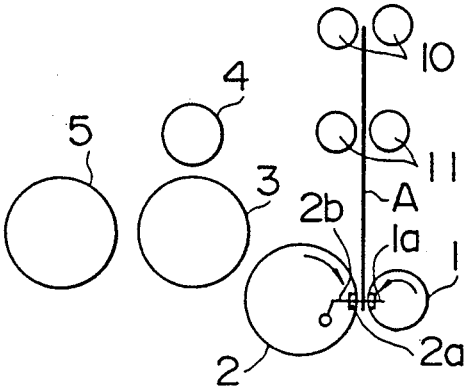
FIG. 8(a) PRIOR ART
FIGS. 8(*a*) through 8(*f*) are schematic side views showing the process for performing inside three folding operation by using the conventional folding machine shown in FIG. 7.
Figure 8D:
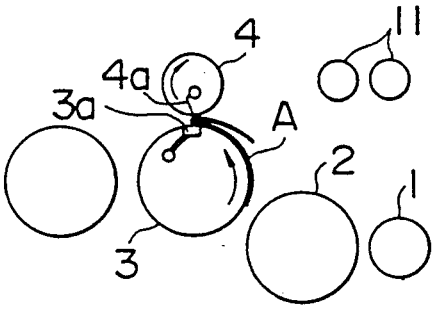
FIG. 8(d) PRIOR ART
Figure 8B:
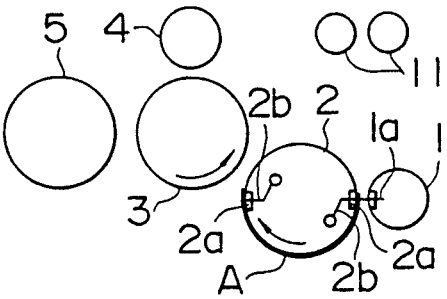
FIG. 8(b) PRIOR ART
Figure 8E:
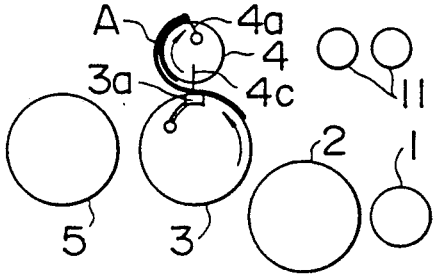
FIG. 8(e) PRIOR ART
Figure 8C:
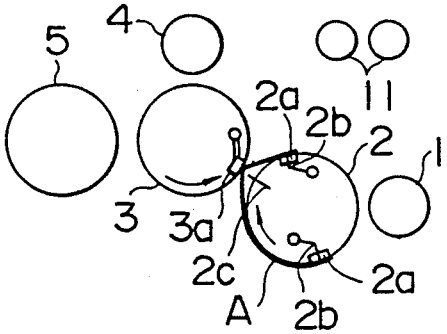
FIG. 8(c) PRIOR ART
Figure 8F:
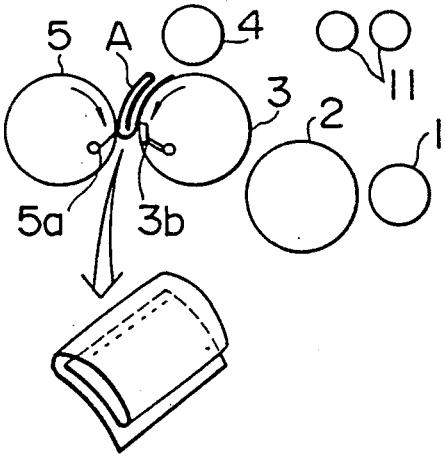
FIG. 8(f) PRIOR ART
Figure 9A:
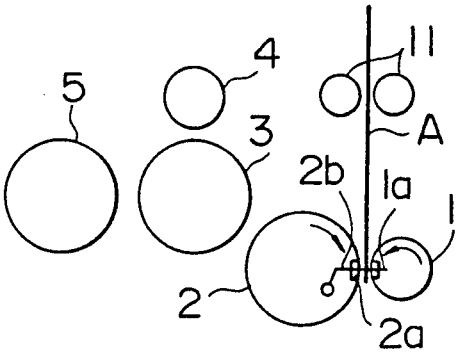
FIG. 9(a) PRIOR ART
FIGS. 9(*a*) through 9(*f*) are schematic side views showing the process for performing outside three folding operation by using the conventional folding machine shown in FIG. 7.
Figure 9B:
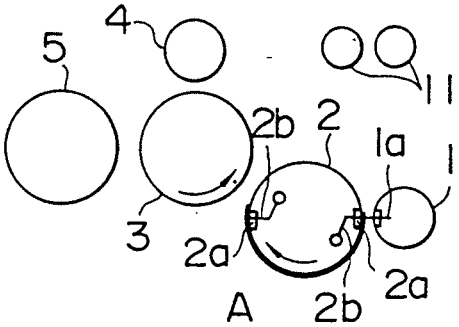
FIG. 9(b) PRIOR ART
Figure 9C:
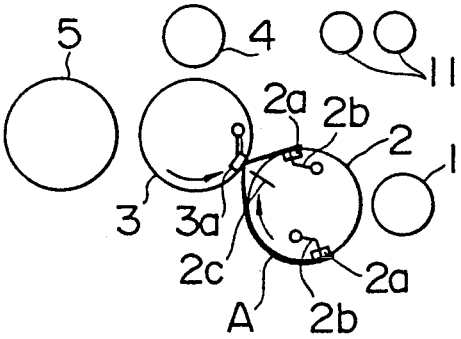
FIG. 9(c) PRIOR ART
Figure 9D:
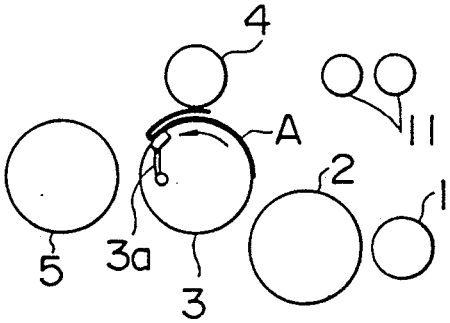
FIG. 9(d) PRIOR ART
Figure 9E:
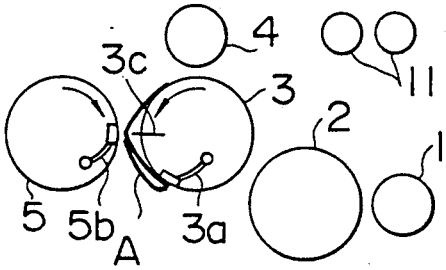
FIG. 9(e) PRIOR ART
Figure 9F:
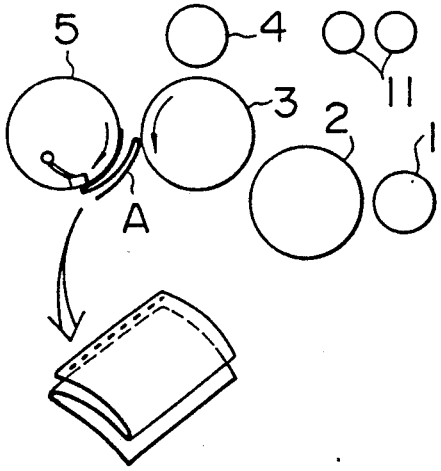
FIG. 9(f) PRIOR ART

On this raising means 23 for preventing interference, an arm is installed at the position of saw blade receiver 2a (refer to FIG. 4) with its tip swaying outward from the folding drum 2 at the position of saw blade receiver 2a as shown in FIG. 6(D) at the time of FIG. 6(C).

The construction of the raising means for preventing interference will be described with reference to FIGS. 4 and 5.

An arm 24 for raising the web is fixedly secured to a shaft 25 rotatively disposed on the drum 2. At one end of the shaft 25 an arm 26 is fixedly secured, to which a cam roller 27 is installed. The cam roller 27, being urged against a cam 28 disposed at the side of the drum 2, rotates the shaft 25 in response to the irregularity of cam 28, and in turn sways the arm 24.

In the above construction, a brush can be used in place of the arm 24.

I claim:

1. A folding machine for folding a paper web in both inside and outside three folding operations comprising:

a cutter drum having a saw blade thereon for cutting the paper web;

a folding drum;

saw blade receivers on said folding drum for receiving said saw blade during cutting of the paper web;

needles on said folding drum for engaging said paper web;

folding blades on said folding drum for engaging the paper web during the folding operation;

a first holding drum;

holding means on said first holding drum for holding the paper web during the folding operations;

folding blades on said first holding drum;

a second holding drum;

holding means on said second holding drum; and raising means on said folding drum in proximity to said saw blade receivers for displacing the paper web to avoid contact between folds of the paper web and prevent interference with said needles during folding operations so that said inside and outside three folding operations are performed, and so that changeover between inside three folding and outside three folding is performed by moving the positions of said saw blade on said cutter drum and said saw blade receivers and needles on said folding drum in relation to said folding blades on said folding drum.

2. A folding machine as claimed in claim 1 wherein each of said raising means comprises:

an arm pivotally mounted on said drum for raising the web; and cam means on said folding drum engaging said pivotally mounted arm means for moving said arm means between a retracted position and a raised position where said arm means displaces the folds of the folded paper web from the needles in proximity to said raising means.

3. A folding machine as claimed in claim 1 wherein said raising means comprises:

an arm means; and a cam means for moving said arm means from a retracted position to a raised position for displacing the folds of the folded paper web from said needles in proximity to said raising means.

4. A folding machine for folding a paper web in both inside and outside three folding operations comprising:

a cutter drum having a pair of saw blades thereon for cutting the paper web;

a folding drum;

a pair of saw blade receivers on said folding drum for receiving said pair of saw blades during cutting operations;

a pair of needles on said folding drum for engaging the paper web;

a pair of folding blades on said folding drum for engaging the paper web during said folding operations;

a first holding drum;

a pair of holding means on said first holding drum for engaging and holding the paper web during folding thereof;

a second holding drum;

a pair of holding means on said second holding drum for holding the paper web during folding thereof; and raising means on said folding drum in proximity to each of said blade receivers for displacing folds of the paper web to prevent contact thereof and interference with said needles during said folding operations, so that inside and outside three folding operations can be carried out and so that changeover between inside three folding and outside three folding is performed by moving only said saw blades on said cutter drum and said saw blade receivers and said needles on said folding drum in relation to said folding blades on said folding drum.

5. A folding machine as claimed in claim 4 wherein each of said raising means comprises:

an arm pivotally mounted on said drum for raising the web; and cam means on said folding drum engaging said pivotally mounted arm means for moving said arm means between a retracted position and a raised position where said arm means displaces the folds of the folded paper web from the needles in proximity to said raising means.

6. A folding machine as claimed in claim 4 wherein said raising means comprises:

an arm means; and a cam means for moving said arm means from a retracted position to a raised position for displacing the folds of the folded paper web from said needles in proximity to said raising means.

* * * * *